United States Patent [19]

Schreiber

[11] Patent Number: 4,836,382

[45] Date of Patent: Jun. 6, 1989

[54] PHOTO PRINT ENVELOPE CONTAINING COUPON POUCH

[75] Inventor: Michael A. Schreiber, Riverside, Conn.

[73] Assignee: Photo Industry Coupon Systems, Stamford, Conn.

[21] Appl. No.: 71,461

[22] Filed: Jul. 9, 1987

[51] Int. Cl.[4] ..... B65D 27/08

[52] U.S. Cl. ..... 206/610; 229/72

[58] Field of Search ..... 206/610, 632; 229/72, 229/73, 68 R, 92.8

[56] References Cited

U.S. PATENT DOCUMENTS

| | | | |
|---|---|---|---|
| 3,982,689 | 9/1976 | Retrum | 206/610 |
| 4,047,661 | 9/1977 | Klein | 229/72 |
| 4,190,161 | 2/1980 | Gendron | 229/72 |
| 4,401,257 | 8/1983 | Benham | 229/72 |
| 4,452,399 | 6/1984 | Schoenleber et al. | 229/72 |
| 4,580,863 | 4/1986 | Gochenour | 206/610 |
| 4,676,526 | 6/1987 | Redman | 229/70 |

*Primary Examiner*—Willis Little

*Attorney, Agent, or Firm*—Lyon & Lyon

[57] ABSTRACT

The present invention generally relates to protection envelopes for storing photographic prints and print negatives and is in particular directed to a photo print envelope having photo print pockets on one side and a pouch for carrying retail coupons on the other.

9 Claims, 3 Drawing Sheets

PHOTO PRINT ENVELOPE CONTAINING COUPON POUCH

BACKGROUND ART

The prior art contains numerous examples of envelopes adapted for storing photographic prints and negatives. These envelopes are typically constructed with one or more pockets in which the photo prints and negatives are inserted. Information identifying the contents of the envelope and instructions for reordering photo prints at the customer's discretion are printed on the envelope surfaces. Frequently, the envelope surfaces also contain descriptive and pictorial advertising. Such advertising may extend to the provision of retail coupons redeemable by the customer toward the purchase of the advertised goods. U.S. Pat. No. 4,047,661 issued to Klein is an example of the latter type of print envelope, wherein a portion of the flap covering the print and negative-carrying envelope pockets consists of removable coupons which can be separated from the remainder of the flap along a tear line. Obviously, the number of removable coupons on a print envelope of the type disclosed in the Klein patent is limited by the amount of surface area left over on the envelope flap, after taking into account the flap area needed to adequately cover the print and negative pockets.

OBJECTS OF THE INVENTION

It is therefore an object of the present invention to provide a print envelope with pockets adapted for carrying photo prints and negatives, which envelope also includes a means adapted to hold a relatively large number of retail coupons for advertising purposes.

This and other objects of the present invention are embodied in a photo print envelope which contains a pouch on one side thereof for carrying retail coupons. Access to the coupon pouch is obtained through a slot cut in the exterior surface of the envelope. A protective cover with a tear-away configuration seals off the slot until the customer desires access to the pouch. The other side of the envelope contains at least two pockets for carrying photographic prints and negatives. An envelope flap folds over the envelope pockets to protect the pocket contents. Simple construction is employed throughout, rendering the envelope suitable for assembly with spot pasting techniques.

BRIEF DESCRIPTION OF THE DRAWINGS

The various objects, features and advantages of the present invention will become more apparent upon consideration of the Best Mode description found below, taken in conjunction with the study of the appended drawings wherein.

BEST MODE FOR CARRYING OUT THE INVENTION

Figure 1:
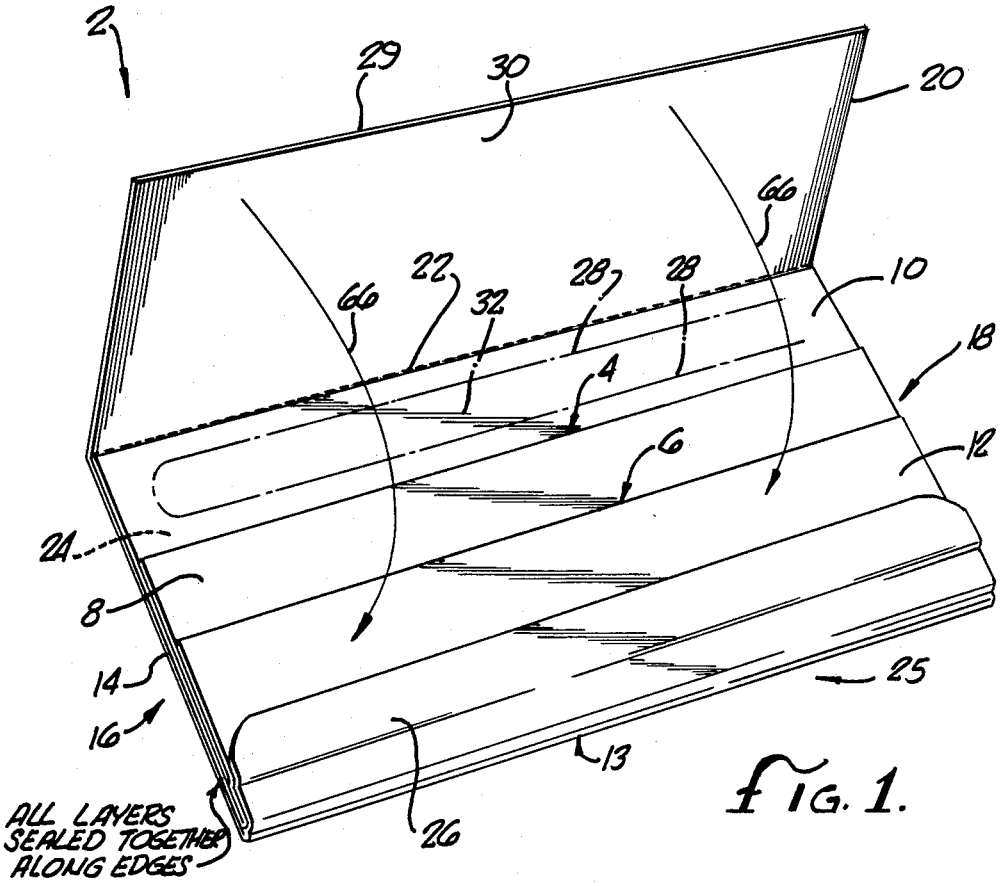
FIG. 1 is a perspective view of a photo print envelope according the present invention, illustrating the print and negative pockets and associated protective flap of the envelope.

The photo print envelope 2 of the present invention is generally depicted in perspective view in FIG. 1. Envelope 2 includes a first pocket 4 into which photographic prints can be inserted and a second pocket 6 in which photographic negatives can be stored. As will be discussed in greater detail below, pocket 4 is constructed from a strip of paper 8 which overlays a paper back panel 10. An inner flap section 12 of back panel 10 is folded over onto strip 8 along crease line 13. The remainder of back panel 10 in turn overlies a paper front panel 14. Adhesive (not shown in FIG. 1) is used to join strip 8, back panel 10, inner flap section 12 and front panel 14 along the edges 16, 18 of the envelope, thereby creating pockets 4 and 6.

Figure 4:
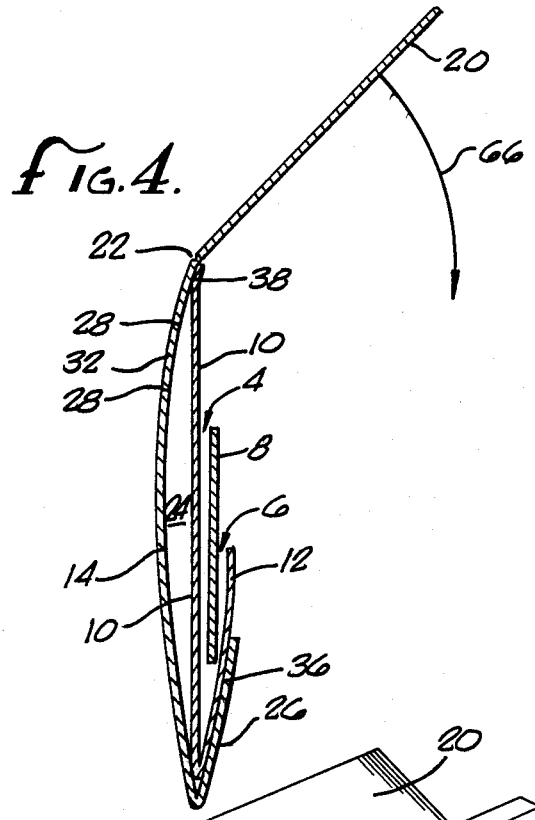
FIG. 4 is a vertical cross-sectional view of the print envelope showing the relationship of the coupon pouch to the print/negative pockets and protective envelope flap.

A pouch inside envelope 2 is formed between back and front panels 10, 12 by folding an upper flap section 20 of front panel 14 over at crease line 22 and securing back panel 10 to front panel 14 via adhesive (not shown in FIG. 1) along the crease line. This pouch, which can be seen to best advantage in the cross-sectional view of FIG. 4, is indicated at 24 in FIG. 1. Retail coupons are inserted into pouch 24 during assembly of envelope 2 through an opening between back and front panels 10, 14 at the bottom 25 of the envelope. After the retail coupons have been inserted into the pouch through this opening, a lower flap section 26 on front panel 14 is folded over and glued to the inner flap section 12 of back panel 10. In this manner, the retail coupons are sealed inside pouch 24. The photoprint customer receiving envelope 2 is able to remove the retail coupons from the pouch through an opening cut into front panel 14, as illustrated by phantom line 28 in FIG. 1. Opening 28 is covered by a disposable pull-tab or other suitable structure (not shown in FIG. 1).

In addition to defining the top of the coupon-carrying pouch 24 at crease line 22, upper flap section 20 of front panel 14 serves as a protective outer cover for print and negative storage pockets 4 and 6. If desired, instructions for ordering duplicate prints from the negatives to be kept in pocket 6 can be displayed on the inner and/or outer surfaces 29, 30 of upper flap section 20. Alternately, advertising material can be displayed on surfaces 29 and 30. Crease line 22 may be perforated to facilitate separation of the upper flap section from the remainder of the envelope when the upper flap section is employed as a duplicate print order form.

Figure 3:
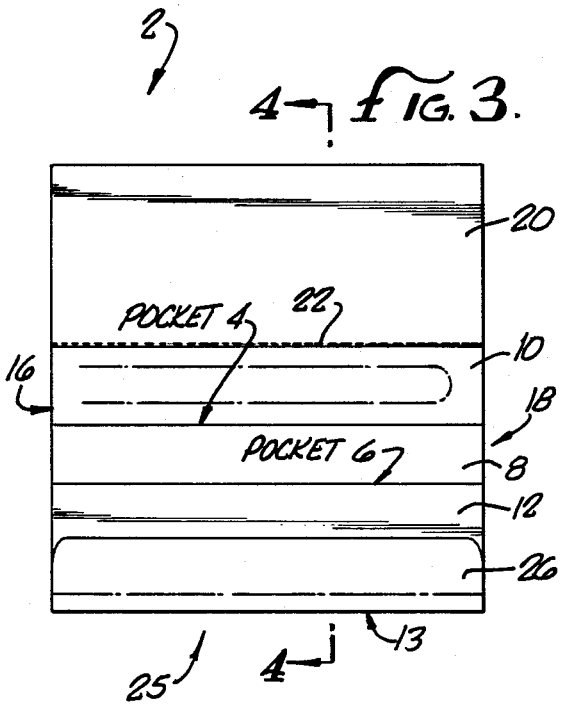
FIGS. 2 and 3 respectively furnish front and rear elevational views of the print envelope.
Figure 2:
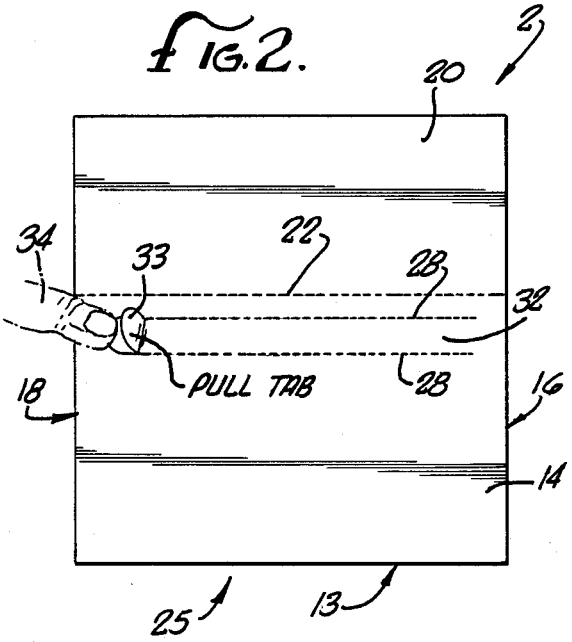

FIGS. 2 and 3 respectively depict the front and rear elevational views of print envelope 2. Turning first to FIG. 2, front panel 14 can be seen. Opening 28 is disposed in the front panel as indicated. A cover 32 is positioned over opening 28 to protect and contain the contents of pouch 24 until the print envelope 2 reaches the customer. In a preferred embodiment of the present invention, cover 32 consists of a pull-tab type of structure formed by perforating front panel 14 in the shape of opening 28. One end 33 of the pull-tab is separated from the front panel, whereby the customer's finger 34 can be inserted underneath the end to permit grasping of the pull-tab. The pull-tab is then peeled back along the perforations and removed from opening 28 to provide access to the interior of pouch 24. Other configurations, such as a paper strip or a single perforated tear line, could be used with equal success to close off or seal the pouch access opening 28. Such configurations would be readily apparent to one of ordinary skill in the art.

Pockets 4 and 6 of print envelope 2 can be seen in the back elevational view of FIG. 3. Pockets 4 and 6 are formed from the juxtaposition of strip 8, back panel 10 and the inner flap section 12 of the back panel, as described briefly above in connection with FIG. 1 and more completely below in connection with FIGS. 5–8. FIG. 3 also illustrates the lower flap section 26 of front panel 14, completely folded over and secured to the outer surface of back panel inner flap section 12. Upper flap section 20 of front panel 14 is shown in FIG. 3 in a semifolded position.

FIG. 4 furnishes a cross-sectional view of print envelope 2, taken along lines A—A of FIG. 3. In particular, strip 8 is positioned across back panel 10 to form the first pocket 4. The folded configuration of the back panel inner flap section 12 which creates second pocket 6 is clearly visible. Lower flap section 26 of front panel 14 is joined to the back panel inner flap section 12 using adhesive 36 as illustrated, in effect sealing off the bottom of pouch 24. Back panel 10 is additionally joined with adhesive 38 along crease line 22 to seal the top of pouch 24. The position of opening 28 and cover 32 relative to the pouch is as indicated.

Figure 5:
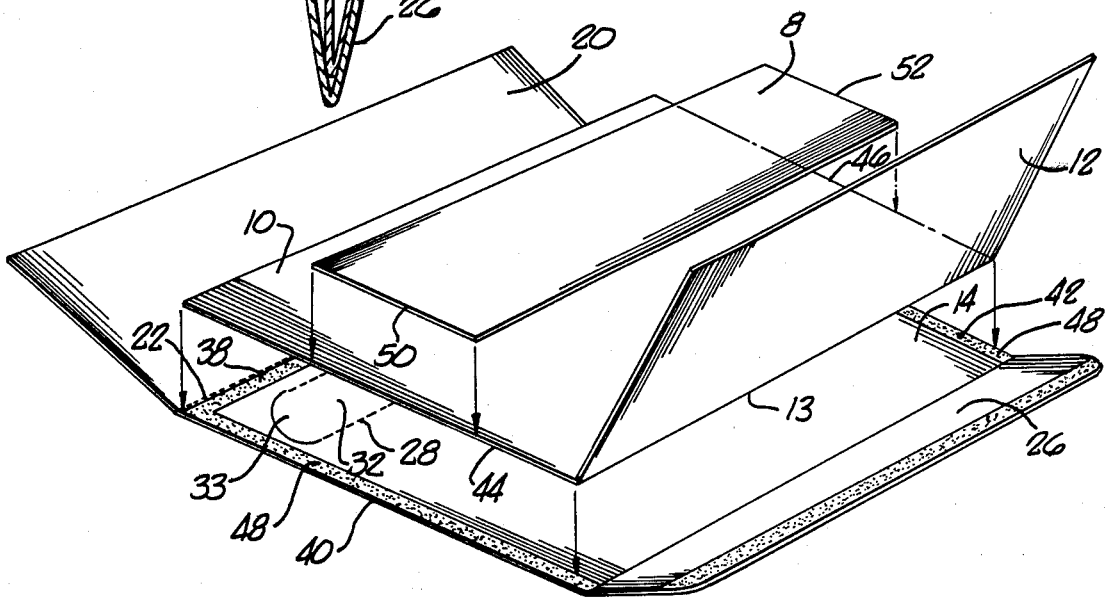
FIGS. 5–8 are perspective views illustrating the assembly of the print envelope incorporating the present invention.
Figure 6:
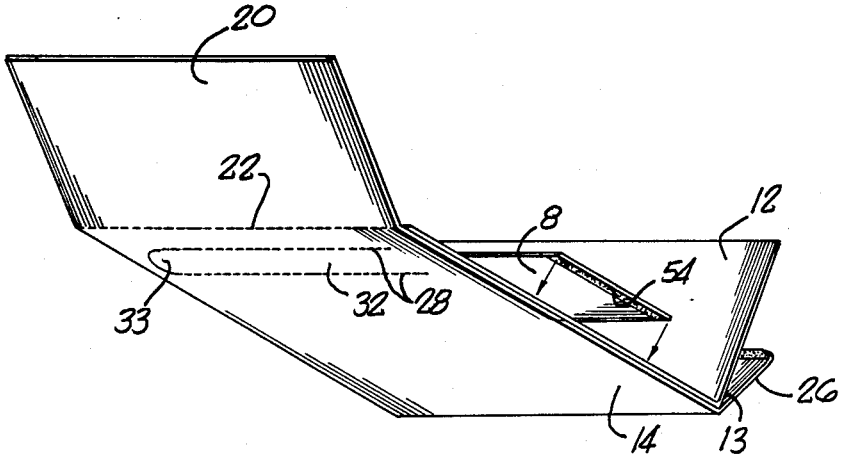

FIGS. 5–8 depict one mode of constructing print envelope 2. The print envelope, incorporating front panel 14, back panel 10 and strip 8, can be fashioned entirely from paper as previously mentioned. Other foldable material could also be employed for the envelope. Referring initially to FIGS. 5 and 6, front panel 14 is perforated with a suitable cutting instrument to form a pull-tab style cover 32. When cover 32 is peeled back, opening 28 remains. Back panel 10 is fastened to front panel 14 along crease line 22 using adhesive 38 while the edges 40, 42 of the front panel are respectively joined to edges 44 and 4 of the back panel using adhesive 48. Strip 8 is subsequently secured along the edges 50, 52 thereof to the edges 44 and 46 of back panel 10, using adhesive 54.

Figure 7:
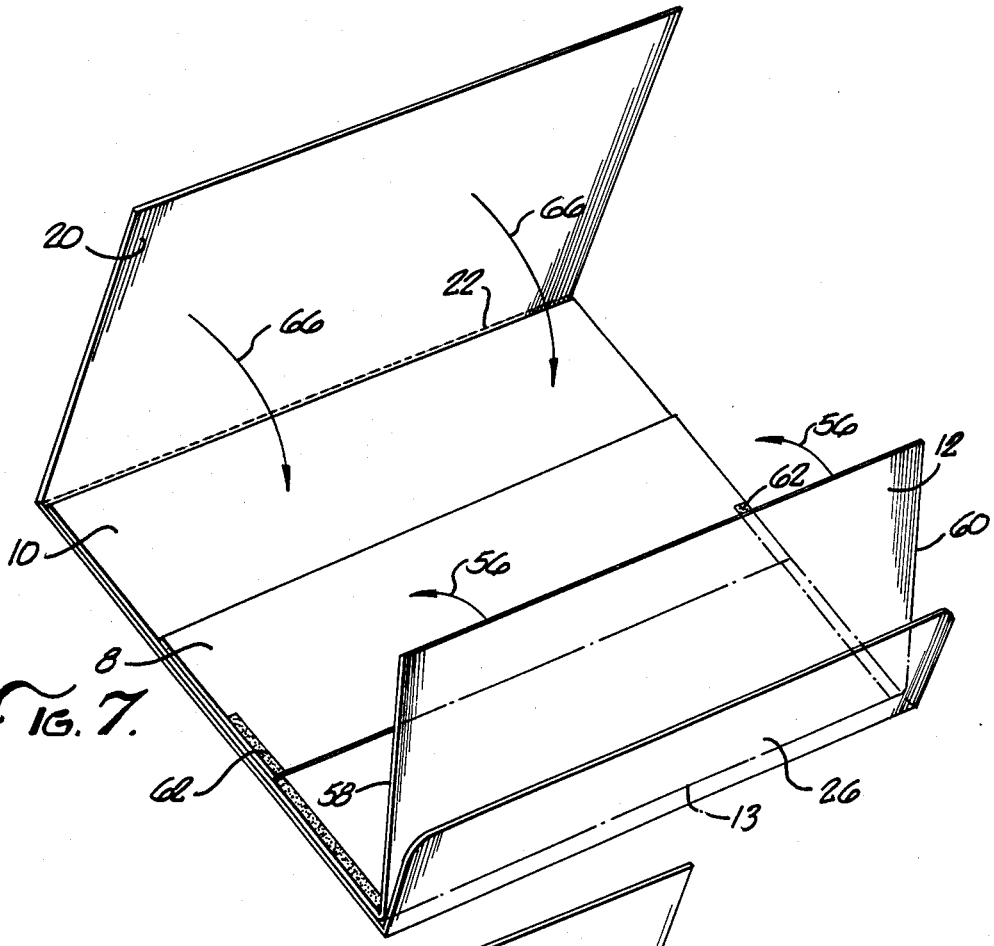

Reviewing FIG. 7 next, the inner flap section 12 of back panel 10 is folded over strip 8 along crease line 13, as indicated by arrows 56. The edges 58, 60 of the inner flap section are glued to the edges 50, 52 of strip 8 and the edges 40, 42 of back panel 10 with adhesive 62. Pocket 6 is accordingly established and the bottom of pocket 4 is simultaneously closed.

Figure 8:
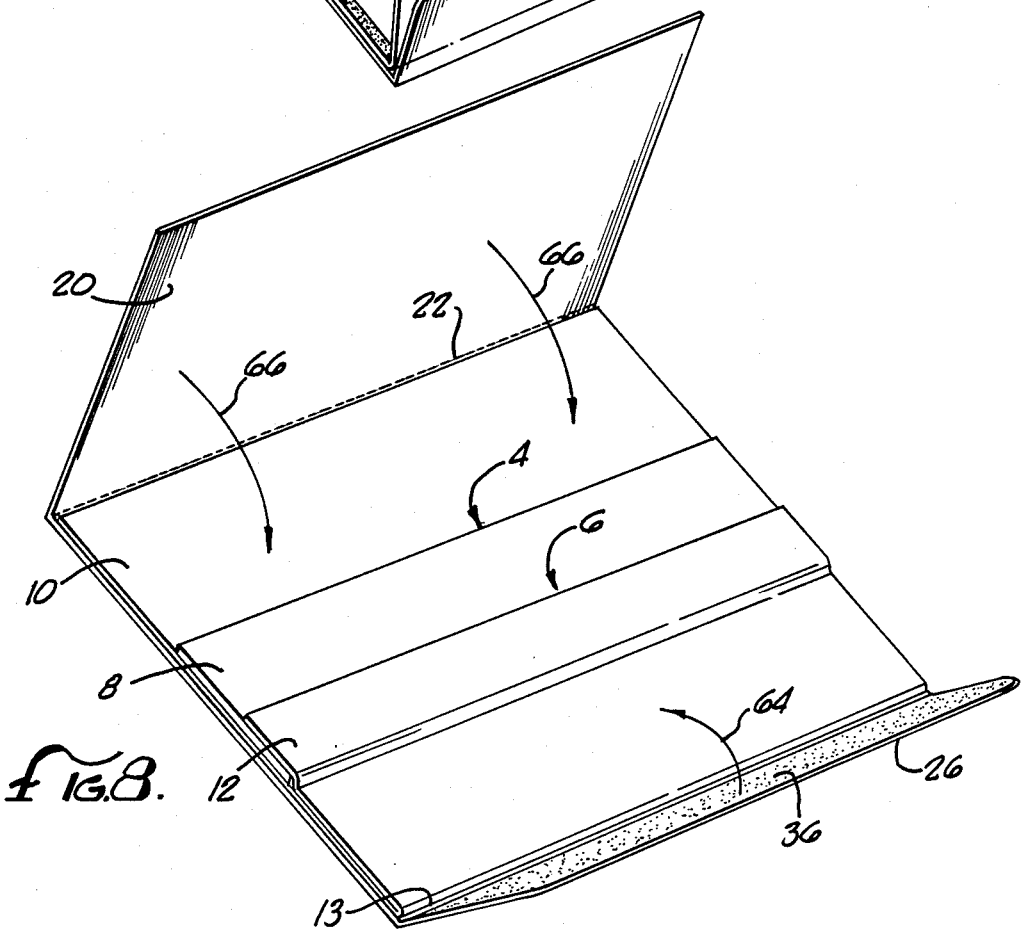

Finally, referring to FIG. 8, it can be seen that an opening into pouch 24 remains. Retail coupons may be inserted into the pouch through this opening. Following insertion of the coupons, the lower flap section 26 of front panel 14 is folded into position over the back panel inner flap section 12, as indicated by arrows 64, and joined via adhesive 36 to seal off the bottom of pouch 24. Upper flap section 20 of front panel 14 is then folded over crease line 22 (indicated by arrows 66) to provide a protective cover for pockets 4 and 6. With envelope 2 so construed, photographic prints and negatives can be inserted into the pockets by the photo finisher, while the retail coupons remain securely stored inside pouch 24 until such time as the print envelope customer removes the pull-tab cover 32 to gain access to the interior of the pouch.

The present invention has been set forth in the form of one preferred embodiment. It is nevertheless understood that modifications to the print envelope disclosed herein, e.g., changing the shape of the front and back panels, adding more pockets to the back panel of the envelope and dividing the envelope pouch into two or more sections, may be made by those skilled in the art without departing from the spirit and scope of the present invention. Moreover, such modifications and variations are considered to be within the purview of the appended claims.

I claim:

1. An envelope comprising:

a pouch structure having an exterior formed from at least first and second surfaces disposed in generally planar relationship to each other and secured completely around the edges thereof to seal off an interior volume for carrying materials;

an opening disposed in one of said first and second surfaces, said opening providing access to said interior volume of said pouch structure;

a releasable sealing structure which covers said opening to close off temporarily said interior volume of said pouch means; and a pocket means joined to said exterior of said pouch structure for carrying additional material, said pocket means including at least a first pocket structure formed from a third surface disposed over said second surface in generally planar relationship thereto, said third surface having at least one edge joined to said second surface to create a first pocket between said second and third surfaces, and third surface also having a second edge which overlies said second surface but is not joined thereto in order to provide an open end in said first pocket for insertion of the additional material.

2. An envelope as set forth in claim 1, wherein said opening is disposed in said first surface of said pouch means.

3. An envelope as set forth in claim 2, wherein said releasable sealing structure is formed by cutting perforations in said first surface in the shape of said opening.

4. An envelope as set forth in claim 3, wherein said releasable sealing structure includes a tab at one end thereof adapted for grasping such that said releasable sealing structure can be pulled away from said first surface along said perforations to leave said opening in said first surface.

5. An envelope as set forth in claim 1, wherein said pocket means also includes a second pocket structure secured to said second surface partially within said first pocket structure.

6. An envelope as set forth in claim, 2, wherein said second pocket structure includes a strip structure having two opposing edges which are secured to said second surface to form a second pocket, said two edges of said strip structure having an orientation relative to said first pocket structure such that said second edge of said first pocket structure not secured to said second surface overlies said strip structure, 7. An envelope as set forth in claim 6, wherein said second surface includes an inner flap portion which is folded back on said second surface to create said third surface of said first pocket structure.

8. An envelope as set forth in claim 7, wherein said first surface includes a lower flap portion which can be folded back on and secured to said inner flap portion of said second surface after said inner flap portion of said second surface has been folded back on said second surface.

9. An envelope as set forth in claim 8, wherein said first surface includes an upper flap portion which can be folded back on said second surface to cover said pocket means.

* * * * *